US006212341B1

(12) United States Patent
Miyamura et al.

(10) Patent No.: US 6,212,341 B1
(45) Date of Patent: Apr. 3, 2001

(54) APPARATUS FOR CONTROLLING THE TONER DENSITY IN AN ELECTROPHOTOGRAPHIC MACHINE

(75) Inventors: Hiroaki Miyamura; Saeko Toda, both of Tokyo (JP)

(73) Assignee: Kyocera Corporation (JP)

( * ) Notice: Subject to any disclaimer, the term of this patent is extended or adjusted under 35 U.S.C. 154(b) by 0 days.

(21) Appl. No.: 09/398,877

(22) Filed: Sep. 20, 1999

(30) Foreign Application Priority Data

Sep. 30, 1998 (JP) ..... 10-278479
Sep. 30, 1998 (JP) ..... 10-278480

(51) Int. Cl.[7] ..... G03G 15/08
(52) U.S. Cl. ..... 399/58; 399/63
(58) Field of Search ..... 399/58, 62, 63, 399/61

(56) References Cited

U.S. PATENT DOCUMENTS 4,901,115 * 2/1990 Nakamura et al. ..... 399/63
4,956,669 * 9/1990 Nakamura ..... 399/62 X
4,974,025 * 11/1990 Kikuchi ..... 399/63
5,216,470 * 6/1993 Asanuma et al. ..... 399/63
5,717,973 * 2/1998 Endoh et al. ..... 399/63 X

FOREIGN PATENT DOCUMENTS 2-64560 2/1990 (JP) .
6-51625 6/1994 (JP) .

* cited by examiner

*Primary Examiner*—Quana M. Grainger
(74) *Attorney, Agent, or Firm*—Fish & Richardson P.C.

(57) ABSTRACT

An apparatus for controlling the density of a developer is described. The apparatus includes a developer container 51 in which a developer is enclosed; a detector 58 for magnetically detecting information about the density of the toner; toner supply for supplying toner in accordance with an output value from the detecting means; waveform forming for reducing an output value from the detecting means by operating mechanical means 56*a* for periodically raking out the developer existing on a detecting surface of the detecting means 58; and delaying means for inhibiting detection of the density of toner from a predetermined time at which the output value has been reduced to a time at which the output value is restored to a stable output value. The toner supply means can be operated in accordance with a value detected after the delay means has been suspended. A developing apparatus incorporating: sampling means for sampling formed waveforms at predetermined intervals; sampling-number setting means for setting the number of sampling operations in a predetermined period; and output-value detecting means for detecting a predetermined output value which is reduced by the sampling means, wherein a determination is made that a malfunction has occurred when the output value which is reduced is not detected by the output-value detecting means after sampling has been performed by a predetermined number of times.

8 Claims, 7 Drawing Sheets

T/C ref : REFERENCE VALUE FOR TONER DENSITY
Tc : PERIOD OF SCRAPER
A : INSTABLE REGION
B : STABLE REGION

APPARATUS FOR CONTROLLING THE TONER DENSITY IN AN ELECTROPHOTOGRAPHIC MACHINE

BACKGROUND OF THE INVENTION

The present invention relates to a developing apparatus adapted to a two-component developing method for use in an electrophotographic method employed in a copying machine, a printer, a facsimile machine or the like. More particularly, the present invention relate to an improvement in control of the density of toner by using a toner-density sensor for magnetically detecting the density of toner and a technique for detecting non-loading of a developer container and a failure of the toner-density sensor by improving the control of the density of the toner.

A conventional method of detecting the density of toner in an image forming apparatus which employs the two-component developing method using toner and a carrier has generally employed a method of magnetically detecting change in the magnetic permeability of the developer. In a case of monochrome images, magnetic toner and a magnetic carrier are employed, while non-magnetic toner and the magnetic carrier are employed in a case of color images. A fact that the mixture ratio of the toner and the carrier is changed and thus the magnetic permeability is changed is used such that the magnetic permeability of the developer is measured. Thus, the density of the toner is detected.

In the foregoing case, an output of, for example, a magnetic-permeability sensor denoting the detected density of the toner is compared with a predetermined reference value. To make the output denoting the detected density of the toner to be the same as the reference value, toner is supplied. Thus, control is performed in such a manner that the density of toner is constant.

However, the developer composed of toner and carrier cannot uniformly be stirred with facility. The developer remains in the vicinity of the detecting surface of the toner-density sensor or toner adheres to the detecting surface of the toner-density sensor after an elapse of long time. Thus, an error occurs in detecting the density of toner.

If an error in detecting the density of toner occurs, the control of the density of toner cannot correctly be performed. Thus, a required density of toner in the developer cannot be realized. Hence it follows that a problem arises in that the print density is lowered, toner is splattered and an undesirable state of the carrier is realized.

To overcome the foregoing problem, a method has been suggested in Japanese Patent Publication JP-2-64560. According to the suggestion, the toner which remains adjacent to the detecting surface is reliably raked out by a mechanical means to exert periodic vibrations on the developer. Moreover, the component of the vibration waveform is superimposed on the output of the toner-density sensor obtainable when no vibration is exerted. Thus, a comparison is made with a reference control level to form a pulse. Thus, the density of toner can be controlled for a long time without remaining of the developer adjacent to the detecting surface.

With the foregoing method, control is performed by using the formed pulse such that the output value, which has intentionally be superimposed, is binary-coded. Therefore, the dynamic range is narrowed excessively. If the dynamic range is widened, the inclination of the period of the vibrations must be moderated. Hence it follows that adjustment must be performed because of joining of the toner-density sensor and dispersion.

Hitherto, a color image forming apparatus has been known which forms a color image by using a plurality of different developer containers in which four different toner materials are enclosed. The four types of the developer containers have been structured such that each developer container is removable when inspection is performed in order to easily perform maintenance and the inspection.

Since the plural developer containers are provided, failure of resetting easily occurs when the container is loaded to perform the maintenance and inspection. To overcome the foregoing problem, a technique has been disclosed in Japanese Patent Publication JP-6-51625. That is, an apparatus is used which reshapes a detection signal supplied from the toner-density sensor into a pulse signal. In accordance with the number of generated pulse signals during a predetermined gate period, the apparatus detects the density. Thus, whether or not the developer container has been loaded is detected by making a determination that the developer container has not been loaded if no pulse signal is generated in the predetermined gate period.

However, the foregoing technique is arranged to simply detect whether or not the pulse signal has been generated in the gate period. If a stirring member of the developer container is broken down owing to stress of the developer or the like, the structure, in which the pulse signal is electrically reshaped, undesirably generates the pulse signal because the developer has been detected. Therefore, the stirring cannot sufficiently be performed. As an alternative to this, a determination is undesirably made that the developer container has not been loaded if the toner sensor is broken down. Hence it follows that accurate detection cannot be performed.

In recent years an image forming apparatus using an a-Si photosensitive material and exhibiting a long life has been developed. If the foregoing technique for detecting the density is employed, the developer remains adjacent to the detecting surface of the toner-density sensor or toner adheres to the detecting surface of the transmission after the apparatus has been used for a long time. Thus, an error occurs in detecting the density of toner. As a result, the density cannot stably be detected for a long time.

SUMMARY OF THE INVENTION

In view of the foregoing, an object of the present invention is to permit use of a product for a long time, prevent remaining of a developer and adhesion of toner in the vicinity of a detecting surface of a toner-density sensor, stably measure and control the density of toner.

Another object of the present invention is to provide a low-cost and reliable product which is capable of detecting the density of toner with a wide dynamic range regardless of joining of a toner-density sensor and dispersion and which does not require an adjustment process.

Another object of the present invention is to provide a developing apparatus which has a simple structure and capable of precisely detecting a state of loading of a developer container and a problem in the developing apparatus which can be used for a long time and which is capable of stably controlling the density of toner.

To achieve the foregoing object, according to one aspect of the present invention, there is provided an apparatus for controlling the density of a developer, comprising a developer container in which a developer composed of a carrier and toner is enclosed; detecting means for magnetically detecting information about the density of the toner in the developer container; toner supply means for supplying the toner in accordance with an output value of information about the detected density of the toner; waveform forming means for forming a waveform obtained by reducing an output value from the detecting means by operating mechanical means for periodically raking out the developer existing on a detecting surface of the detecting means; and toner-density-detection delaying means for inhibiting detection of the density of the toner from a predetermined time at which the output value has been reduced by the waveform forming means to a time at which the output value of information about the density of the toner is restored, wherein the toner supply means can be operated in accordance with information about the density of the toner detected after the operation of the toner-density-detection delaying means has been suspended.

Since the foregoing structure is employed with which the developer on the detecting surface is periodically raked out by the mechanical means, remaining of the developer and adhesion of toner to the detecting surface can be prevented. As a result, the density of the developer can stably be detected for a long time. When periodical vibration waveform is exerted, the output value from the detecting means is intentionally reduced. Since the reduced output value does not represent a true density of toner, the detection of the density of toner is inhibited from a predetermined time at which the output value has been reduced to a time at a stable output value of information about the density of toner is obtained. Therefore, stable detection of the density of toner can be performed. Since the detection of the density of the developer can be performed in a stable region, any influence of the position at which the toner-density sensor is joined and dispersion is exerted. Hence it follows that the density of the developer can be controlled without a necessity of performing adjustment.

Preferably, minimum-value detecting means for detecting a minimum value or a value close to the minimum value of the output value which is reduced by the waveform forming means is provided so that the toner-density-detection delaying means is operated when the minimum value or the value close to the minimum value has been detected.

The minimum value or a value close to the minimum value of the density of the developer is detected so that the period in which the control of the density of the toner is inhibited is measured with a simple structure. Therefore, the density of the developer can furthermore stably be detected.

The detection which is performed by the minimum value detecting means is performed such that a predetermined detection region is provided for the output value which is reduced by the waveform forming means and the minimum value or a value close to the minimum value is detected from the output value in the detection region. Since the detection region is provided for performing the detection, high resistance against noise can be realized. Thus, malfunction can be prevented.

In the foregoing case, the mechanical means incorporates an elastic member joined to a stirring member for stirring the developer. Since the elastic member is joined to the stirring member, stable rotations of the stirring member enable stable vibration period to be exerted.

Moreover, a timing switch is disposed adjacent to the detecting surface, the timing switch is switched on at timing at which the waveform forming means rakes out the toner, and the toner-density-detection delaying means is operated when the timing switch has been switched on.

Since the toner-density-detection delaying means is operated at the timing of the waveform forming means which is capable of stably rotating, stable detection of the density can be performed.

Furthermore, to achieve the above-mentioned object, according to another aspect of the present invention, there is provided a developing apparatus incorporating: a developer container in which a developer composed of a carrier and toner is enclosed; toner-density detecting means for magnetically detecting information about the density of the toner in the developer container; and waveform forming means for forming a waveform obtained by reducing an output value from the detecting means by operating mechanical means for periodically raking out the developer existing on a detecting surface of the detecting means so that the density of the toner is controlled in accordance with the output value of a waveform of vibrations formed by the waveform forming means, the developing apparatus comprising: sampling means for sampling the waveform of vibrations at predetermined intervals; sampling-number setting means for setting the number of sampling operations in a predetermined period of the waveforms of the vibrations; and output-value detecting means for detecting a predetermined output value which is reduced by the sampling means, wherein a determination is made that a malfunction has occurred when the output value which is reduced is not detected by the output-value detecting means after sampling has been performed by a predetermined number of times.

As a result of employment of the foregoing structure, the developer on the detecting surface is periodically raked out by the mechanical means. Therefore, adhesion of the remaining toner can be prevented, causing the developing apparatus to be used for a long time. The stirring operation of the mechanical means causes the output value to be reduced at predetermined periods. Therefore, a fact can easily be recognized that a state that the output value, which is reduced, cannot be detected is occurrence of non-loading, a failure of the mechanical means or a failure of the toner-density sensor.

The output-value detecting means may detect a minimum value or a value close to the minimum value of the output value reduced by the sampling means. The minimum value or a value close to the minimum value of the density of the developer is detected so that lowering of the output value is reliably detected. Therefore, accuracy can be improved.

A structure may be employed in which the detection of the minimum value or a value close to the minimum value is performed such that a predetermined detection region is provided for the output value which is reduced and the minimum value or a value close to the minimum value is detected from the output value in the detection region. Since the detection region is provided to perform the detection, high resistance against noise can be realized. Hence it follows that malfunction can be prevented.

DETAILED DESCRIPTION OF THE PREFERRED EMBODIMENTS

Embodiments of the present invention will now be described with reference to the drawings.

Figure 1:
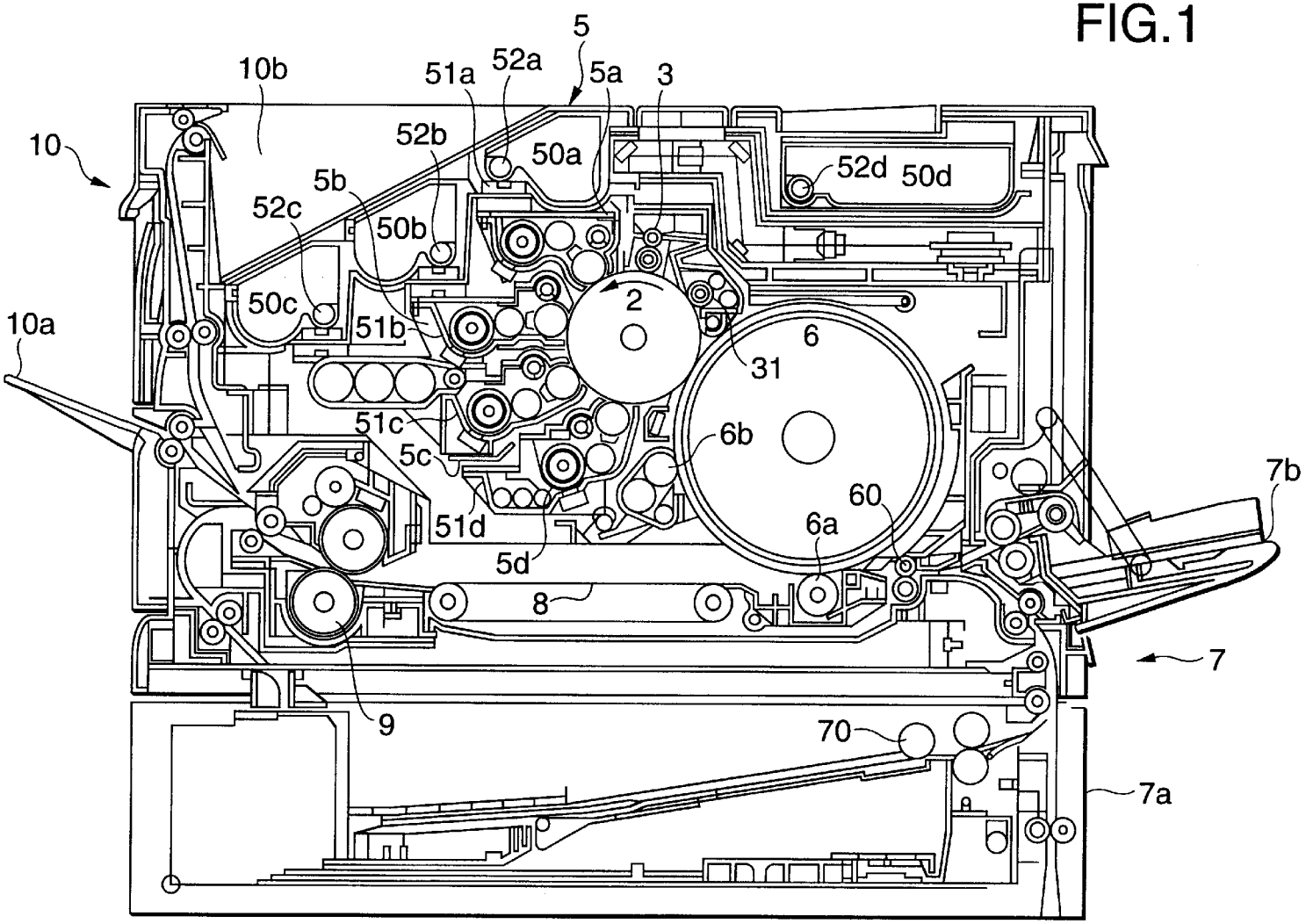
FIG. 1 is a diagram schematically showing a color-image forming apparatus according to the present invention.

FIG. 1 is a diagram schematically showing a color-image forming apparatus according to the present invention. Reference numeral 1 represents a body of the color-image forming apparatus. Reference numeral 2 represents a photosensitive drum incorporating OPC or an a-Si photosensitive material. Reference numeral 3 represents a charging roller which is capable of applying a predetermined bias voltage to the surface of the photosensitive drum 2 from a power source (not shown). Reference numeral 4 represents an exposing means for irradiating the charged surface of the photosensitive drum 2 with a laser beam denoting information of an image from an external unit so as to form a latent image. In the foregoing case, light of LED may be employed.

Reference numeral 5 represents a developing unit for developing color toner on the formed latent image. A developing unit 5*a* for developing a yellow image, a developing unit 5*b* for developing a magenta image, a developing unit 5*c* for developing a cyan image and a developing unit 5*d* for developing a black image are disposed in a direction from an upstream position in the direction in which the photosensitive drum 2 is rotated. The developing units 5 is structured as follows. The following elements are disposed: a toner container 50*a* filled with yellow toner and a developer container 51*a* for developing the toner supplied by a supply roller 52*a*; a toner container 50*b* filled with magenta toner and a developer container 51*b* for developing the toner supplied by a supply roller 52*b*; a toner container 50*c* filled with cyan toner and a developer container 51*c* for developing the toner supplied by a supply roller 52*c*; and a toner container 50*d* filled with black toner and a developer container 51*d* for developing the toner supplied by a supply roller 52*d*. The foregoing elements are disposed in the upper portion of the color-image forming apparatus. The toner according to the present invention is non-magnetic toner. Reference numeral 31 represents a cleaning means for removing, from the photosensitive drum 2, toner which has not been transferred on an intermediate transfer drum 6 which will now be described.

Reference numeral 6 represents the intermediate transfer drum for repeating, for each toner, a process for applying a predetermined bias to primarily transfer the developed toner to the photosensitive drum 2 so as to superimpose colors. Reference numeral 6*a* represents a secondary transfer roller and 6*b* represents a cleaning roller. The superimposition of the color is performed such that the secondary transfer roller 6*a* and the cleaning roller 6*b* are retracted from the intermediate transfer drum 6 by a retracting means (not shown) until the foregoing colors are completely superimposed.

Reference numeral 7 represents a paper feeding means incorporating a paper feeding unit 7*a* which is disposed in the lower portion of the color-image forming apparatus 1 and on which a large quantity of paper are stacked to cause a paper feeding roller 70 to feed upper paper; and a manual feeding unit for feeding the paper one by one. The paper fed by the paper feeding means 7 is moved to a regist roller 60 so that the alignment of the leading end of the paper is performed and timing is adjusted. Then, the paper is moved to a secondary transfer roller 6*a* at timing of the toner subjected to the superimposition of the colors by the intermediate transfer drum 6. After an image has been transferred, the paper is moved to an outlet portion by a moving belt 8. Reference numeral 9 represents a fixing means disposed adjacent to the outlet portion to fix, to the paper, the toner, which has been secondarily transferred, by using heat and pressure.

Reference numeral 10 represents a paper discharging means incorporating a face-up tray 10*a* for discharging the paper fixed by the fixing means 9 using heat such that the printed surface of the paper face upwards; and a face-down tray 10*b* for discharging the paper such that the printed surface faces downwards.

Figure 2:
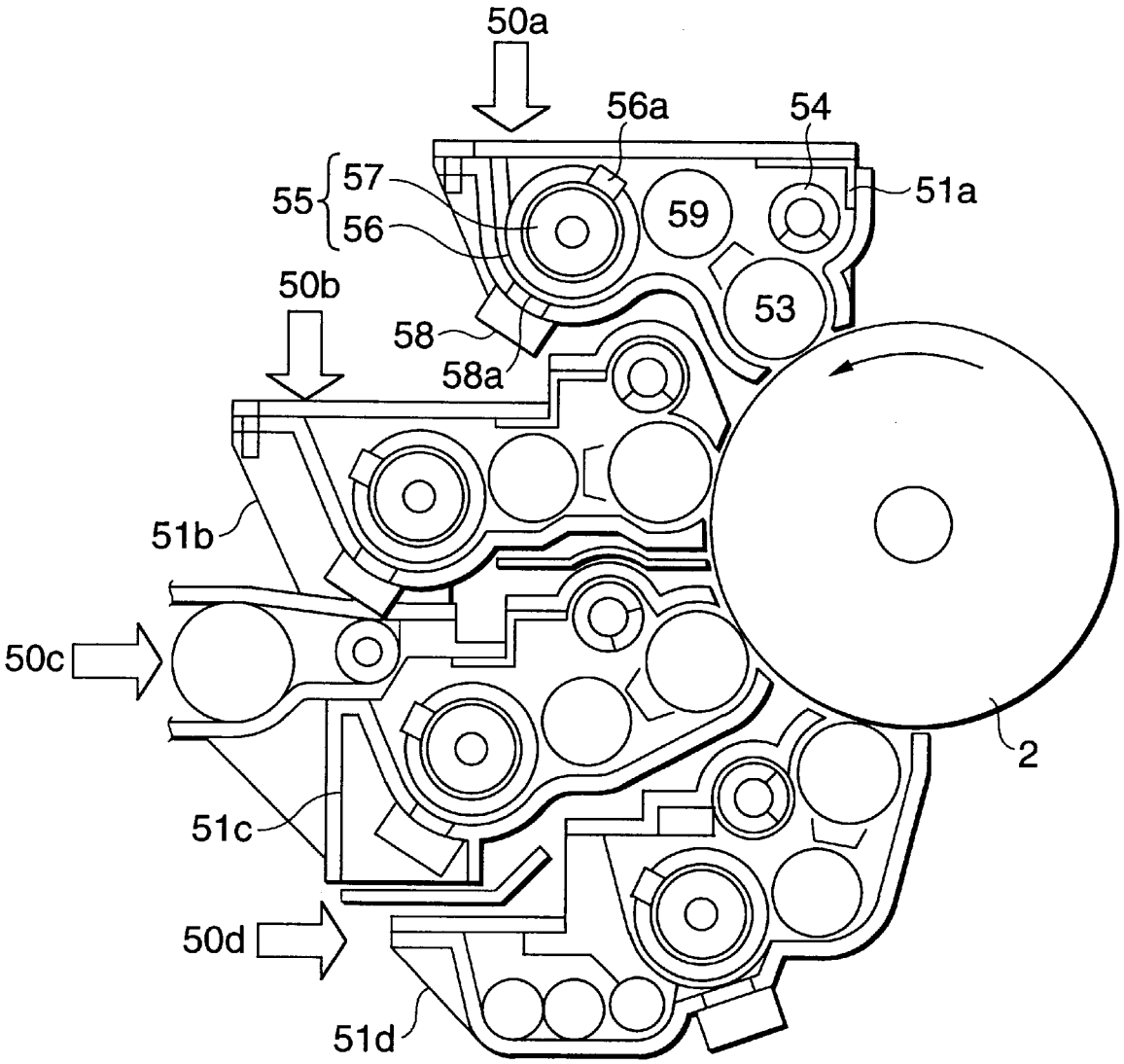
FIG. 2 is a diagram showing the internal mechanism of a developing apparatus according to the present invention.

The structure of the developing unit according to the present invention will now be described. FIG. 2 is a diagram showing the internal structure of the developing unit. As shown in FIG. 2, toner material in the foregoing colors are supplied from the toner supply containers 50*a* to 50*d* (not shown) to the developer containers 51*a* to 51*d*. A magnetic carrier and toner in each color in each of the developer containers 51*a* to 51*d* can be mixed with each other. To simplify the description, only the mechanism of the developing unit 5*a* will now be described. Since the other developing units have the same function, description of the other developing units are omitted.

Reference numeral 53 represents a developing roller including a magnet (not shown). The magnetic force of the magnet enables the developing roller 53 to be rotated such that the developer in which the toner and the carrier have been mixed in the developer container 51*a* is carried on the surface of the developing roller 53. Reference numeral 54 represents a developer limiting member including a magnet to form a magnetic shield to move the developer to the position opposite to the photosensitive drum 2 only when the developing operation is performed. Reference numeral 55 represents a first mixer 55 incorporating an outer mixer 56 and a screw-type inner mixer 57 in order to improve the stirring performance. The outer mixer 56 is provided with a scraper 56*a* (an elastic member) which is a characteristic of the present invention.

The scraper 56*a* is constituted by bonding an urethane foam member to a rubber member. If only the urethane foam member is used, deformation occurs owing to the pressure of the developer. Thus, toner on the surface of the toner-density sensor cannot sufficiently be raked out. Therefore, the rubber member which is free from considerable deformation is disposed to form a lower layer. Then, the urethane foam member is bonded to the upper surface of the rubber member.

Reference numeral 58 represents a toner-density sensor (a detecting means) which is a magnetic permeability sensor. The toner-density sensor 58 is structured to magnetically detect change in the density (the volume) of toner of the developer moved to the surface of the detecting surface 58*a* and then allowed to remain on the detecting surface 58*a*. The toner of the developer allowed to remain on the detecting surface 58*a* is periodically raked out by the elastic member 56*a*. Note that reference numeral 59 represents a second mixer for moving the developer to the developing roller 53 while stirring the developer.

As a result of employment of the foregoing structure, the scraper member 56*a* is rotated when the first mixer 55 has been rotated. Thus, the developer can be stirred at predetermined periods. The toner-density sensor 58 detects the foregoing state so that vibrations at the predetermined periods are detected.

Figure 3:
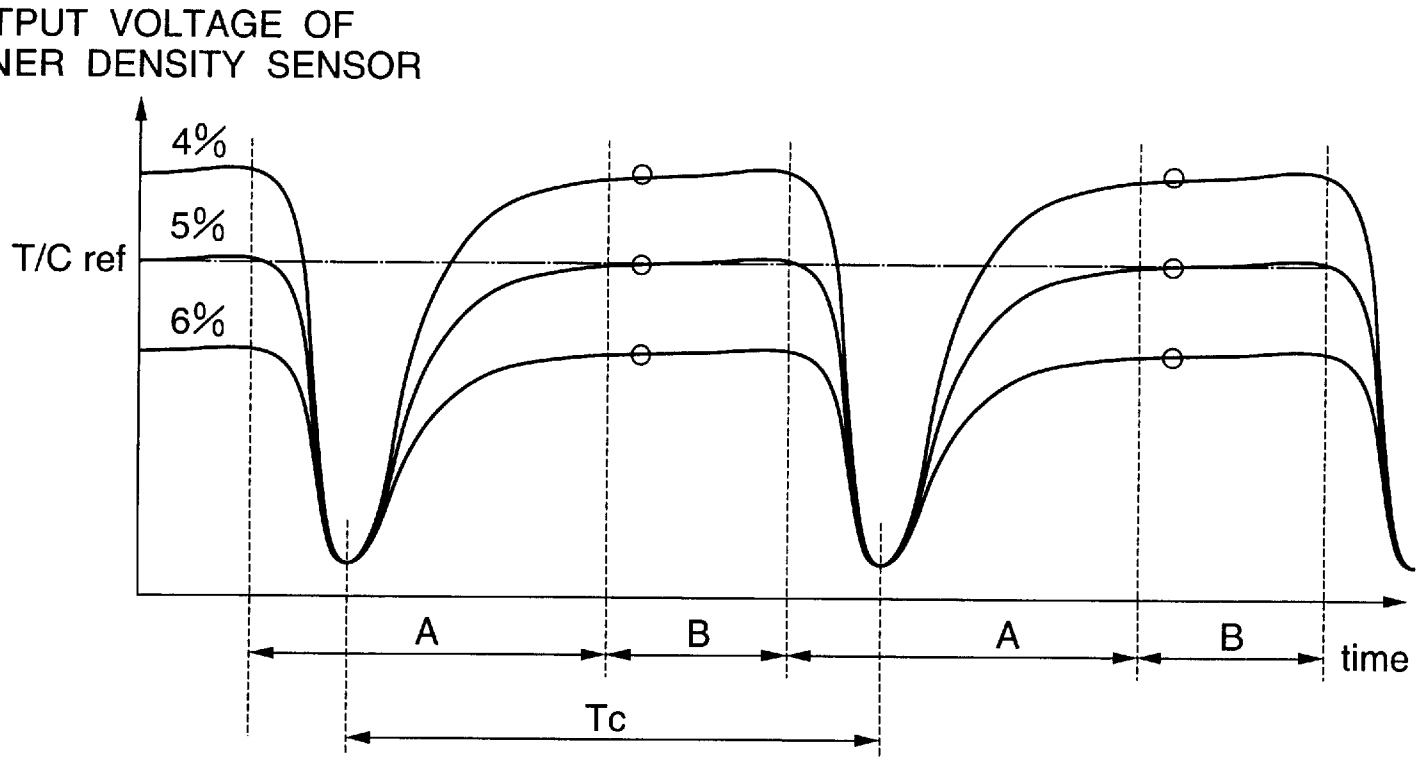
FIG. 3 is a graph showing output characteristics obtainable from a toner-density sensor.

An output characteristic obtainable from the toner-density sensor 58 disposed in the above-mentioned structure is shown in FIG. 3. FIG. 3 shows output voltages realized when the densities of toner are 4%, 5% and 6%, respectively. As shown in FIG. 3, when the mixture ratio (the density) of toner and the carrier is raised, the output voltage is lowered. In the foregoing structure, supply of toner and the like are performed with respect to a reference value T/Cref for the density of toner so as to maintain a predetermined density. The reason why the voltage is lowered in region A at predetermined periods is that the developer allowed to remain on the detecting surface of the toner-density sensor is raked out by the scraper 56*a*. The periodical rotations of the scraper 56*a* cause intentional vibration waveform components to be superimposed on a usual output value. Thus, the output value of the toner-density sensor 58 is reduced. Since the foregoing region A is formed to intentionally reduce the output value, there is possibility that the detection of the density of the toner in the foregoing region is performed instably. Therefore, the present invention is structured such that the density of toner is not detected in the region A (the toner-density-detection delaying means). As an alternative to this, data Xi about detected T/C is obtained in stable region B which is a proper output value obtainable from the developer.

The foregoing stable region B can easily be detected because the structure is formed such that the position at which the scraper 56*a* is always fixed and substantially no change in the output voltage occurs. The detection in the stable region B enables the toner-density sensor 58 to detect the density of toner sufficiently apart from the scraper 56*a*. Therefore,the density of toner can furthermore stably be detected without any influence of mechanical change. Although one detecting operation is performed in the period TC of the scraper 56*a*, the detecting timing is not limited to this.

Figure 4:
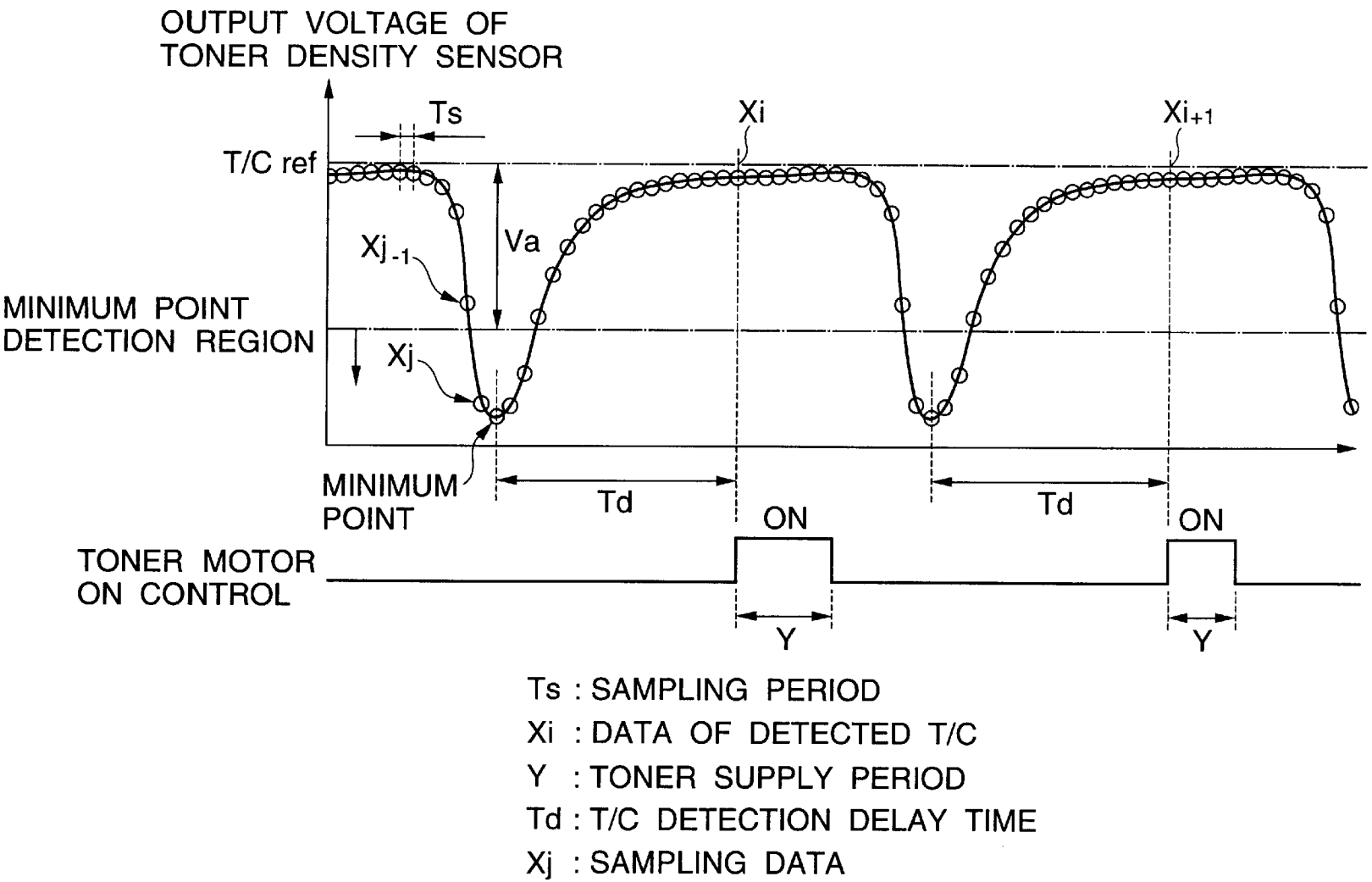
FIG. 4 is a graph showing output characteristics obtainable from a toner-density sensor.

The period of time in which the detection of the density of toner is not performed is started at a predetermined time at which the output value of the toner-density sensor 58 has been reduced. The "predetermined time" is not limited. Therefore, the foregoing period of time may be started at any time in the instable region in which the output value of the toner-density sensor has been reduced. As shown in FIG. 4, a method may be employed in which sampling of the output values is performed to measure a minimum point. Then, time required from the minimum point to start the predetermined stable region B is measured by using a timer. Thus, control of toner is delayed for time Td. In the foregoing case, a region for detecting the minimum point to perform the detection of the minimum point in only a region in which the density is lower than the reference value T/Cref by Va. Thus, the minimum point can stably be performed without any influence of noise.

When the foregoing detection of density is performed, great change in the design with which the reference value T/Cref for the density of toner is greatly is changed requires only change in Va. Therefore, a great influence is not exerted on the method of detecting the minimum point.

The toner-density sampling period Ts must be sufficiently short with respect to the period Tc of the scraper to reliably perform the detection of the minimum point. It is preferable that the sampling period Ts is not longer than 1/10 of the period Tc of the scraper, preferably not longer than 1/20. Since the scraper makes periodical outputs, measurement of the period enables determinations whether or not a developing unit has been joined, whether or not a problem of the toner-density sensor has arisen and whether or not the scraper has been broken down to be performed.

Figure 5:
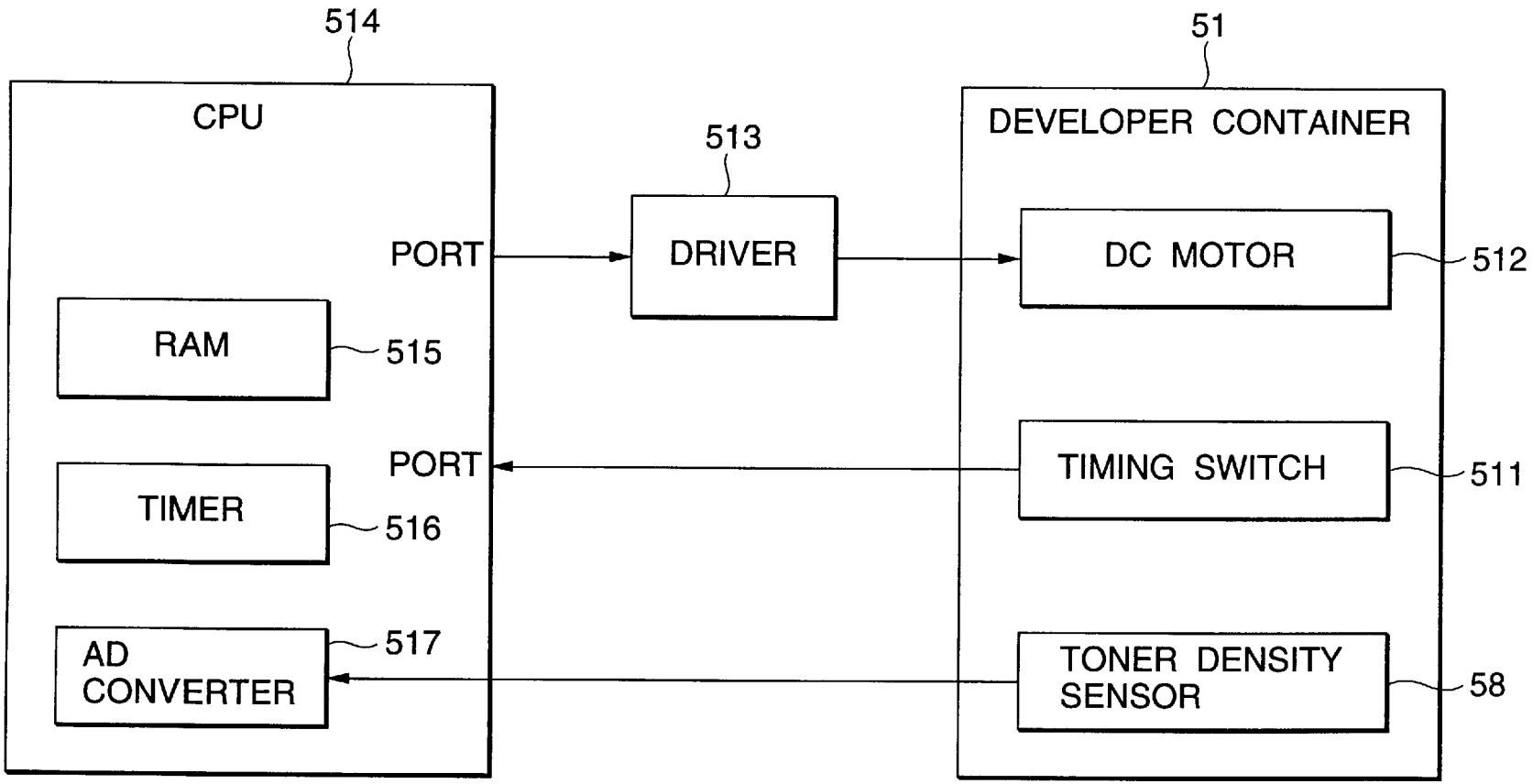
FIG. 5 is a block diagram of a control portion according to the present invention.

FIG. 5 is a block diagram of a control portion according to the present invention. The control portion incorporates a CPU 514 including a RAM 515, a timer 516, an A/D converter 517 and so forth; a DC motor for supplying toner; and a driver 513 for rotating the DC motor. The timer 516 performs interruption at predetermined periods Ts to cause the output of the toner-density sensor 58 to be digitized by the AID converter 517. The digitized density value of toner is processed with software to calculate time for which the DC motor 512 is rotated. Thus, rotation and stop of the DC motor 512 is controlled in accordance with the on output from the port. The output for rotating/stopping the DC motor 512 is used by the driver 513 to actually rotate the DC motor 512 so as to supply toner. It is preferable that the DC motor 512 is a motor, such as a governor motor, the speed of which is controlled, because a predetermined quantity of toner which must be supplied can be maintained.

As indicated with a dashed line shown in FIG. 5, a timing switch 511 may be disposed at a position (not shown) adjacent to the detecting surface 58*a* of the developer container 51. The timing switch 511 is switched on corresponding to the timing at which the scraper 56*a* rakes out the toner. The control of the density of toner may be delayed such that the time at which the predetermined stable region B starts is measured by the timer 516 with respect to the time at which the timing switch 511 has been switched on. Note that the CPU 514 is not required to include the RAM 515, the timer 516, the A/D converter 517 and so forth. The foregoing units may be disposed on the outside.

Figure 6:
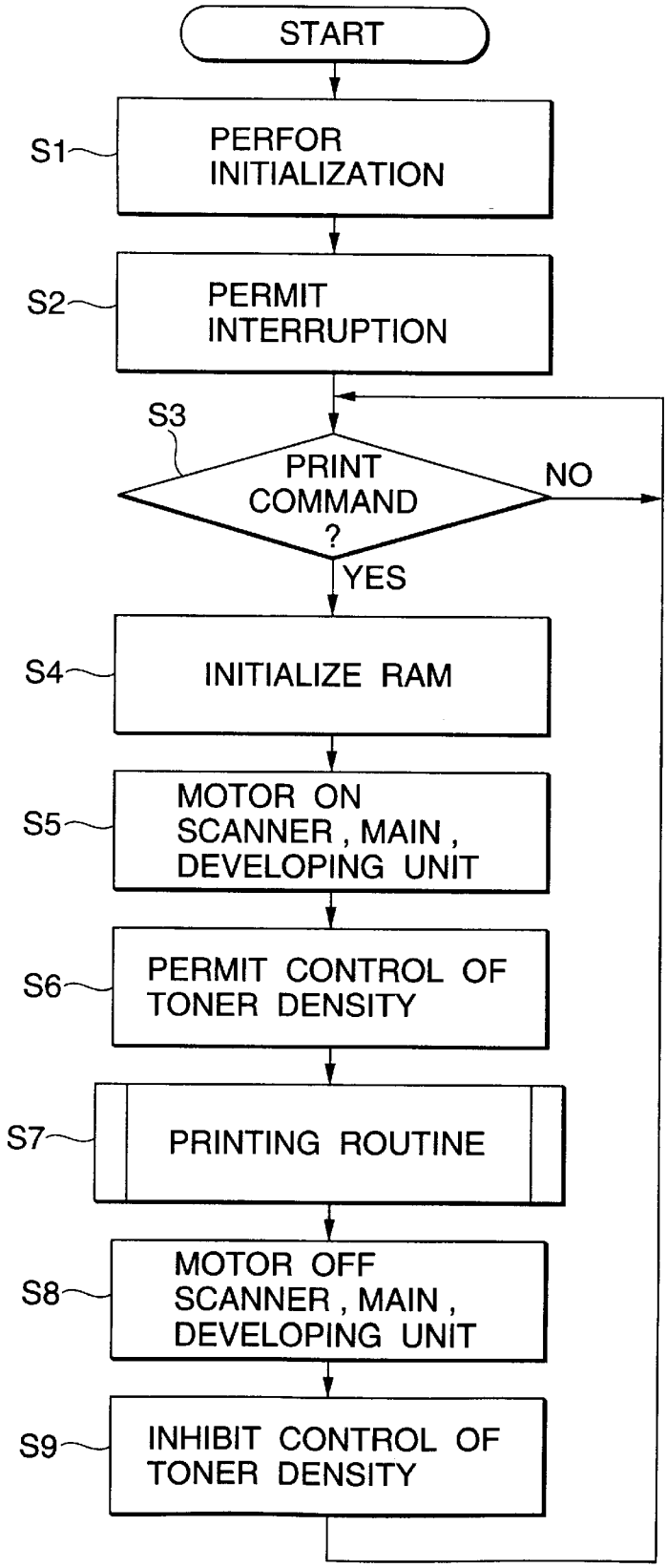
FIG. 6 is a flow chart of the overall control of the density of toner according to the present invention.
Figure 7:
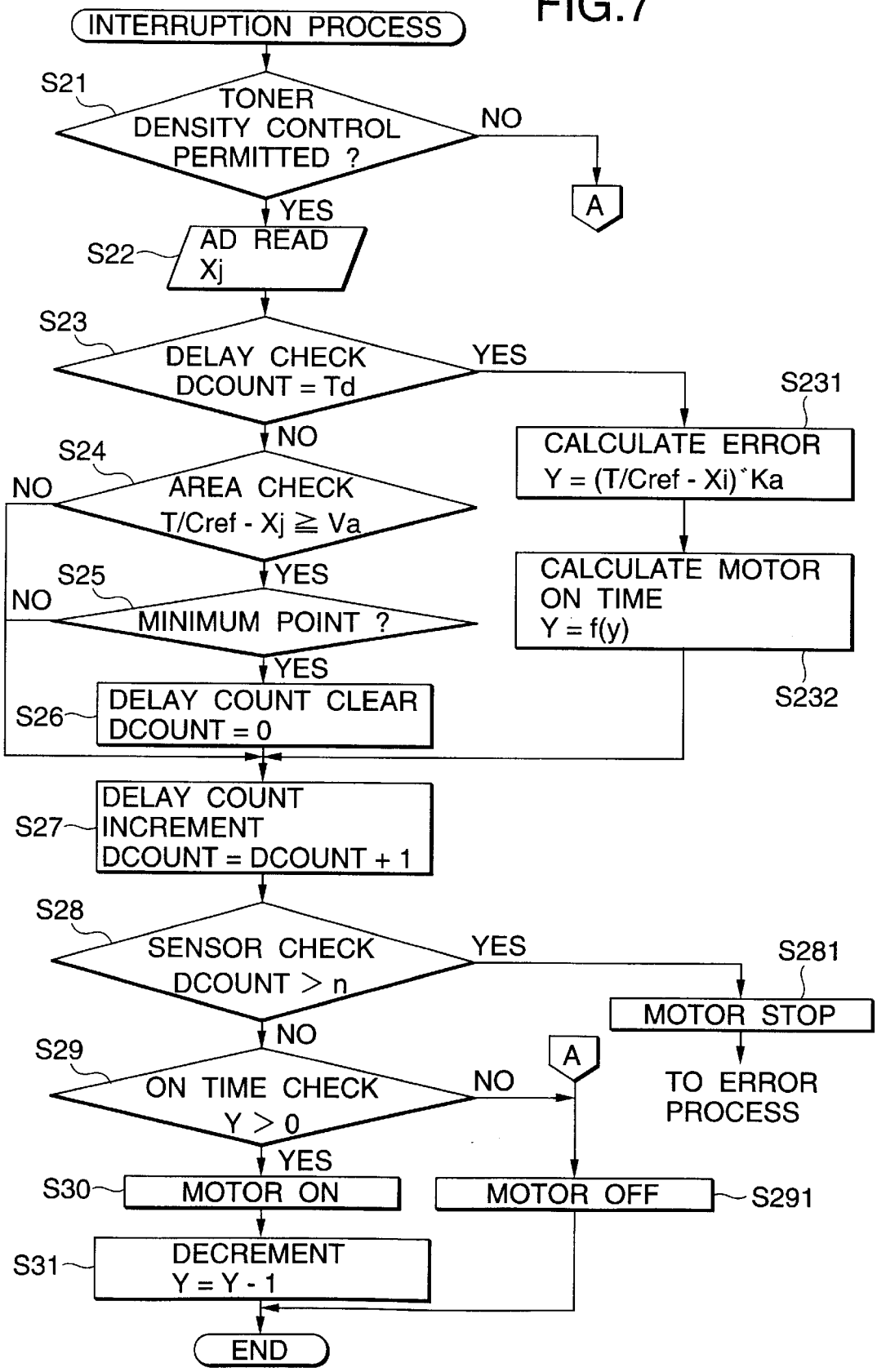
FIG. 7 is a flow chart of a process for measuring the density of toner according to the present invention.

The flow of the operation according to the present invention will now be described with reference to FIGS. 6 and 7. FIG. 6 is a flow chart showing total control of the density of toner, and FIG. 7 is a flow chart showing a process according to the present invention for measuring the density of toner.

After electric power has been supplied, the CPU 514 performs initialization, including clearing of the RAM 515, setting initial values of variables, initialization of the setting of the timer 516 and so forth (S1), and then permits interruption (S2) . Then, a print command is waited for, and then the CPU 514 is put on standby (S3). When a print command has been issued, the CPU 514 initializes the variables of the RAM 515 to turn on scanner, the main unit and the developing motor so as to rotate the foregoing units. Then, the CPU 514 permits control of the density of toner (S4 to S6). Then, a printing process is performed (S7). Then, the rotation of the motor is interrupted, the control of the density of toner is inhibited and a print command is waited for (S9).

The flow chart of the operation in the interruption process will now be described with reference to FIG. 7. As the toner-density control delay means according to the present invention, only control of a type with which a minimum point is measured (the control shown in FIG. 4) will now be described.

The process for interruption of the control of the density of toner is performed by checking whether or not the control has been permitted (S21). If the control is not permitted, the toner motor is stopped and the process is completed. If the control is permitted, the output of the toner-density sensor is digitized by the A/D converter 517 (S22). Then, whether or not the present moment of time is included in the T/C detection delay time Td, that is, whether or not the present moment of time is the timing at which the density of toner is read is determined (S23). If the present moment of time is not the reading timing, whether or not the region is the region for checking the minimum value is determined by making a comparison between a value obtained by subtracting the digitized value Xj from the reference value T/Cref and an eigen value Va (S24). If the region is not the region for checking the minimum value, skipping of the operation is performed. If the region is the region for checking the minimum value, whether or not the value is the minimum value is determined by making a comparison with the previous value Xj-1 (S25). If the value is not the minimum value, skipping of the operation is performed. If the value is the minimum value, a delay counter in the RAM 515 which has been written in the previous process is cleared (S26).

The operation is returned to step S23. When the timing is timing on the outside of the time Td for delaying the detection of T/C and at which the density of toner is read, the operation proceeds to step S231. Thus, the deviation between the reference value T/Cref and the read value is obtained. Then, the obtained deviation is multiplied with feedback gain Ka so that a feedback amount y is obtained. Then, the feedback amount y is converted into time for which the motor is rotated. Then, upper and lower limits are provided and the time Y for which the motor is rotated is calculated (S232).

After all of the foregoing processes have been completed, the delay counter in the RAM 515 is incremented (S27). Then, the toner-density sensor is checked according to the value of the delay counter.

The delay counter is arranged to enlarge the count if the minimum value is not detected. Therefore, in accordance with whether or not the number n of sampling in the sampling period Ts is larger than the scraper period Tc, whether or not a developing unit exist or the error of the sensor can be determined (S28). In the foregoing case, the number n of sampling in one period has been set in the timer 516. Therefore, the set number and the number of sampling are compared with each other. If occurrence of an error is determined, that is, if the number is larger than the set number, the toner supply motor is stopped. Thus, an error process routine is performed (S281). Thus, whether or not the toner-density sensor 58 has been broken down, whether or not the elastic member 56*a* has been broken down and, therefore, the vibration waveform cannot be obtained or whether or not the developing unit has not been loaded is determined.

If no error is detected as a result of checking of the toner-density sensor, the time for which the toner supply motor is rotated is determined (S29). The determination of the toner supply motor is performed in accordance with whether or not the time Y for which the motor is rotated is longer than zero. If Y is longer than zero, the toner supply motor is rotated (S30). Then, the value Y in the RAM 515 is decremented and the process is completed (S31). If Y is shorter than zero, the toner supply motor is turned off and the process is completed (S291). The time Y for which the toner supply motor is rotated can be set at the intervals of the sampling period Ts.

As a result of the foregoing structure, remaining of the developer and adhesion of toner to the portion adjacent to the toner-density sensor can be prevented. Thus, the density of toner can stably be performed for a long time. Hence it follows that the control of the density of toner can stably be performed. Moreover, detection of the density of toner can be performed with a wide dynamic range. As a result, a reliable product regardless of the joining of the toner-density sensor and dispersion can be provided. In addition, the adjustment process can be omitted and, therefore, a low-cost product can be provided.

The present invention enables a state of loading of the developer container and a problem in the developing apparatus to precisely be detected with a simple structure. Thus, use for a long time is permitted and control of the density of toner can be performed. As described above, significant effects can be obtained.

What is claimed is:

1. An apparatus for controlling the density of a developer, comprising:

a developer container in which a developer composed of a carrier and toner is enclosed;

detecting means for magnetically detecting information about the density of the toner in said developer container;

toner supply means for supplying the toner in accordance with an output value of information about the detected density of the toner;

waveform forming means for forming a waveform obtained by reducing an output value from said detecting means, by operating mechanical means for periodically raking out the developer existing on a detecting surface of said detecting means; and toner-density-detection delaying means for delaying detection of the density of the toner for a delay time period, from a time at which the output value has been reduced by said waveform forming means, to a time at which the output value of information about the density of the toner is restored, wherein said toner supply means is operable in accordance with information about the density of the toner detected after said delay time period.

2. An apparatus for controlling the density of a developer comprising:

a developer container in which a developer composed of a carrier and toner is enclosed;

detecting means for magnetically detecting information about the density of the toner in said developer container;

toner supply means for supplying the toner in accordance with an output value of information about the detected density of the toner;

waveform forming means for forming a waveform obtained by reducing an output value from said detecting means, by operating mechanical means for periodically raking out the developer existing on a detecting surface of said detecting means;

toner-density-detection delaying means for delaying detection of the density of the toner for a delay time period, from a time at which the output value has been reduced by said waveform forming means, to a time at which the output value of information about the density of the toner is restored, wherein said toner supply means is operable in accordance with information about the density of the toner detected after said delay time period; and minimum-value detecting means for detecting a minimum value or a value close to the minimum value of the output value which is reduced by said waveform forming means, wherein said toner-density-detection delaying means is operated when the minimum value or the value close to the minimum value has been detected.

3. An apparatus for controlling the density of a developer according to claim 2, wherein the detection which is performed by said minimum value detecting means is performed such that a predetermined detection region is provided for the output value which is reduced by said waveform forming means and the minimum value or a value close to the minimum value is detected from the output value in the detection region.

4. An apparatus for controlling the density of a developer according to claim 1, wherein said mechanical means incorporates an elastic member joined to a stirring member for stirring the developer.

5. An apparatus for controlling the density of a developer according to claim 4, wherein a timing switch is disposed adjacent to the detecting surface, said timing switch is switched on at timing at which said waveform forming means rakes out the toner, and said toner-density-detection delaying means is operated when said timing switch has been switched on.

6. A developing apparatus comprising:

a developer container in which a developer composed of a carrier and toner is enclosed;

toner-density detecting means for magnetically detecting information about the density of the toner in said developer container;

waveform forming means for forming a waveform obtained by reducing an output value from said detecting means by operating mechanical means for periodically raking out the developer existing on a detecting surface of said detecting means so that the density of the toner is controlled in accordance with the output value of a waveform of vibrations formed by said waveform forming means;

sampling means for sampling the waveform of vibrations at predetermined intervals;

sampling-number setting means for setting the number of sampling operations in a predetermined period of the waveforms of the vibrations; and output-value detecting means for detecting a predetermined output value which is reduced by said sampling means, wherein a determination is made that a malfunction has occurred when the output value which is reduced is not detected by said output-value detecting means after sampling has been performed by a predetermined number of times.

7. A developer apparatus according to claim 6, wherein said output-value detecting means detects a minimum value or a value close to the minimum value of the output value reduced by said sampling means.

8. An apparatus for controlling the density of a developer according to claim 7, wherein the detection of the minimum value or a value close to the minimum value is performed such that a predetermined detection region is provided for the output value which is reduced and the minimum value or a value close to the minimum value is detected from the output value in the detection region.

* * * * *